US011781514B2

(12) United States Patent
Maiwald et al.

(10) Patent No.: US 11,781,514 B2
(45) Date of Patent: Oct. 10, 2023

(54) APPARATUS FOR PRESSURE CONTROL IN A FUEL FEED OF AN INTERNAL COMBUSTION ENGINE HAVING COMMON RAIL INJECTION

(71) Applicant: KENDRION (VILLINGEN) GMBH, Villingen-Schwenningen (DE)

(72) Inventors: Wolfram Maiwald, Obereschach (DE); Ralf Heingl, Villingen-Schwenningen (DE); Harald Burkart, Villingen-Schwenningen (DE)

(73) Assignee: KENDRION (VILLINGEN) GMBH, Villingen-Schwenningen (DE)

( * ) Notice: Subject to any disclaimer, the term of this patent is extended or adjusted under 35 U.S.C. 154(b) by 0 days.

(21) Appl. No.: 17/778,345

(22) PCT Filed: Sep. 8, 2020

(86) PCT No.: PCT/EP2020/075112

§ 371 (c)(1),
(2) Date: May 19, 2022

(87) PCT Pub. No.: WO2021/099001

PCT Pub. Date: May 27, 2021

(65) Prior Publication Data

US 2022/0397085 A1 Dec. 15, 2022

(30) Foreign Application Priority Data

Nov. 21, 2019 (DE) ..... 102019131537.9

(51) Int. Cl.
*F02M 63/02* (2006.01)

(52) U.S. Cl.
CPC ..... *F02M 63/023* (2013.01); *F02M 63/02* (2013.01)

(58) Field of Classification Search
CPC ..... F02M 63/023; F02M 63/02; F02M 2200/8061; F02M 63/025; F02M 63/0052; F16L 25/14; F16L 33/16
See application file for complete search history.

(56) References Cited

U.S. PATENT DOCUMENTS 3,349,649 A * 10/1967 Mele ..... F16C 35/02 411/455
3,387,735 A * 6/1968 De Marco ..... F16L 55/13 220/289

(Continued)

FOREIGN PATENT DOCUMENTS

CN 1904345 A * 1/2007 ..... F02M 63/0015
CN 1948742 A * 4/2007 ..... F02M 51/005

(Continued)

OTHER PUBLICATIONS

Office Action dated Aug. 19, 2020, in corresponding application DE 10 2019 131 537.9.

*Primary Examiner* — Hung Q Nguyen
(74) *Attorney, Agent, or Firm* — Nath, Goldberg & Meyer; Jerald L. Meyer; Morgan D. Rosenberg

(57) ABSTRACT

The present invention relates to an apparatus (1) for pressure control in a fuel feed of an internal combustion engine with a common rail injection, comprising a housing (10) with an opening (15), and an electromagnetic high pressure valve (30), wherein the electromagnetic high pressure valve (30) is at least partially inserted into the opening (15) of the housing (10) at the end, wherein the electromagnetic high pressure valve (30) is connected in a pressure-tight manner in the opening (15) to the housing (10) by a connection (20) and the connection (20) has a first portion (21) and at least one second portion (22), and wherein the first portion (21)

(Continued)

Figure 1:
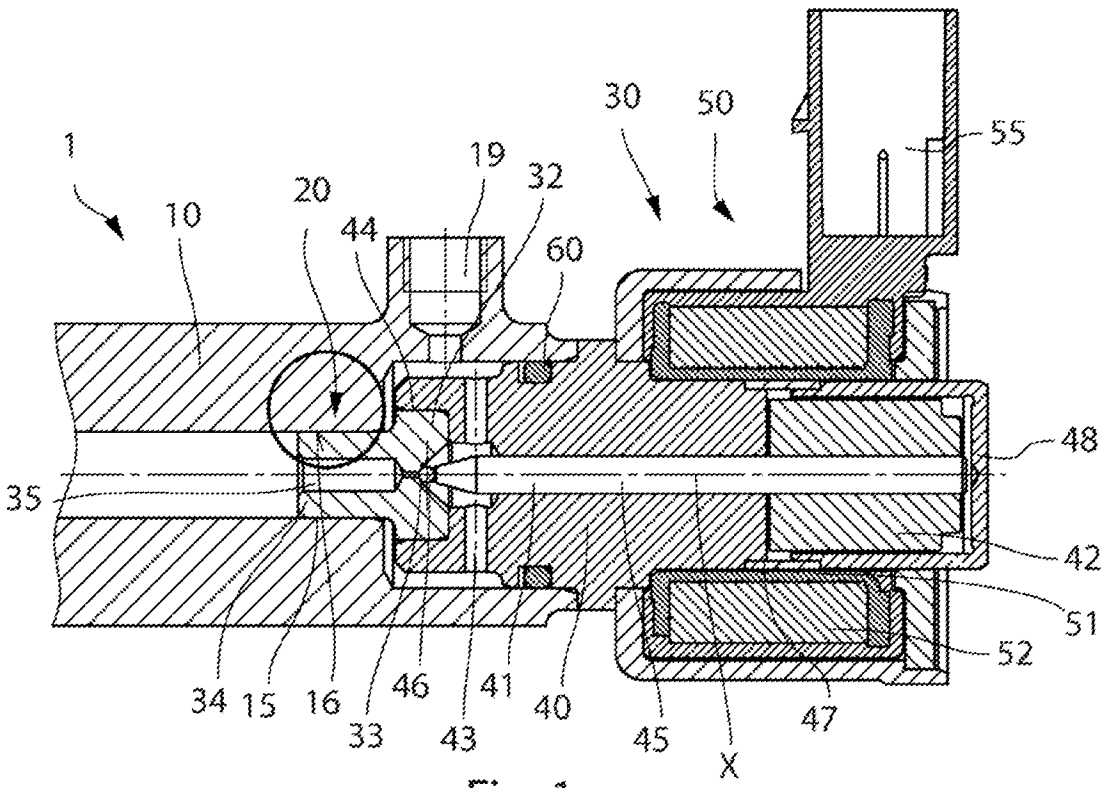

and the at least one second portion (22) have different mechanical and/or geometric properties.

18 Claims, 3 Drawing Sheets

(56) References Cited

U.S. PATENT DOCUMENTS

| | | | | | |
|---|---|---|---|---|---|
| 5,439,257 | A * | 8/1995 | Williamson | F16L 41/084 | 285/288.1 |
| 5,732,985 | A * | 3/1998 | Suzuki | F16L 19/0225 | 285/332 |
| 5,879,060 | A | 5/1999 | Mergerle et al. | | |
| 6,170,888 | B1 * | 1/2001 | Ridenour | F16L 13/142 | 29/523 |
| 9,599,258 | B1 * | 3/2017 | Green | F16L 13/116 | |
| 2002/0121824 | A1 * | 9/2002 | Obara | H02K 5/1737 | 310/90 |
| 2007/0034819 | A1 | 2/2007 | Mitsumata et al. | | |
| 2008/0056914 | A1 * | 3/2008 | Usui | F02M 55/04 | 417/307 |
| 2008/0231042 | A1 * | 9/2008 | Brayman | F16L 25/10 | 285/41 |

FOREIGN PATENT DOCUMENTS

| | | | | | |
|---|---|---|---|---|---|
| CN | 101004160 | A | * | 7/2007 | F02M 55/025 |
| CN | 101230820 | A | * | 7/2008 | B21D 39/06 |
| CN | 102537386 | A | * | 7/2012 | F02M 63/0036 |
| CN | 106593730 | A | * | 4/2017 | F02M 59/46 |
| CN | 112066103 | A | * | 12/2020 | F16L 13/165 |
| DE | 602005003427 | T2 | * | 9/2008 | F02M 59/34 |
| DE | 102012205397 | A1 | * | 10/2013 | F02M 55/005 |
| DE | 102014220226 | A1 | | 4/2016 | |
| DE | 102012205397 | B4 | * | 7/2017 | F02M 55/005 |
| EP | 1582788 | A1 | | 10/2005 | |
| JP | 2002005319 | A | * | 1/2002 | F16K 17/0406 |
| JP | 2004197834 | A | * | 7/2004 | |
| JP | 2009108784 | A | * | 5/2009 | B23K 11/16 |
| JP | 2009257197 | A | * | 11/2009 | |
| JP | 2010-216359 | A | | 9/2010 | |
| JP | 2011528420 | A | * | 11/2011 | |
| JP | 2012158987 | A | * | 8/2012 | |
| JP | 2019070391 | A | * | 5/2019 | F02M 55/04 |
| JP | 6833709 | B2 | * | 2/2021 | B21D 39/04 |
| WO | WO-9613681 | A1 | * | 5/1996 | E21B 17/0426 |
| WO | WO-2004027253 | A1 | * | 4/2004 | F02M 47/027 |

* cited by examiner

APPARATUS FOR PRESSURE CONTROL IN A FUEL FEED OF AN INTERNAL COMBUSTION ENGINE HAVING COMMON RAIL INJECTION

This is a National Phase Application filed under 35 U.S.C. 371 as a national stage of PCT/EP2020/075112, filed Sep. 8, 2020, an application claiming the benefit of German Application No. 102019131537.9 filed Nov. 21, 2019, the content of each of which is hereby incorporated by reference in its entirety.

The present invention relates to an apparatus for pressure control in a fuel feed of an internal combustion engine having common rail injection with the features of claim 1, as well as to an internal combustion engine having common rail injection with the features of claim 19.

A multitude of apparatuses for pressure control in a fuel feed of an internal combustion engine with a common rail injection are known from the prior art. Internal combustion engines of this type are typically diesel engines in the prior art, which have a pumping device with one or more high pressure pumps, through which pump the fuel is provided at a pressure between $1500*10^5$ Pa and $3000*10^5$ Pa in a common rail housing for injection into a cylinder. The common rail housing is connected on the input side to the high pressure pump, which supplies the fuel under pressure, and on the output side to injectors, which inject the fuel under high pressure into the cylinder.

With a common rail injection, the pressure in the supplied fuel can be provided independently of the operating point of the internal combustion engine, making pre-injection, main injection and post-injection possible. The high pressure of the fuel in the common rail housing also enables a particularly fine atomization of the fuel by the injector and a high entrainment of the fuel in the cylinder.

In order to control the pressure of the fuel in the common rail housing, on the one hand, the pressure is provided by a high pressure pump, and, on the other hand, excess fuel is discharged from the common rail housing by a high pressure valve when the pressure in the common rail housing exceeds a predetermined pressure.

An apparatus of this type for adjustment of the pressure in a common rail housing is known, for example, from DE 10 2012 205 397 A1 and comprises a common rail housing with an opening, which is in connection on the inlet side to a high pressure pump and on the output side to an injector, as well as an electromagnetic high pressure valve, which is inserted on the end side at least partially into the opening of the common rail housing by means of a press-fit connection.

From this prior art, it has been shown to be a disadvantage that the connection from the prior art between the common rail housing and the electromagnetic high pressure valve is not sufficiently suitable to withstand particularly high pressures of up to $3000*10^5$ Pa, which is why further sealing measures are required. In particular, it has been shown to be disadvantageous during assembly of the prior art apparatus that shavings build up when the electromagnetic high pressure valve is pressed in, which makes the press-fit connection between the electromagnetic high pressure valve and the common rail housing permeable to pressure. The force required to join the two components is also very high and therefore complex in terms of manufacturing. The use of synthetic fuels is also a major challenge, since the materials used in the prior art for non-metallic seals react with them.

It is here where the present invention comes into play.

It is therefore the task of the present invention to provide an apparatus for pressure control in a fuel feed of an internal combustion engine having common rail injection, which expediently eliminates the disadvantages known from the prior art and realizes a high-pressure-resistant connection between a common rail housing and combines simple and inexpensive manufacturing processes.

These tasks are solved by an apparatus for supplying fuel to an internal combustion engine having the features of patent claim 1 as well as by an internal combustion engine having the features of patent claim 19.

Further advantageous configurations of the invention are given in the sub-claims.

The apparatus according to the invention for pressure control in a fuel feed of an internal combustion engine having common rail injection comprises a housing, in particular a common rail housing, and an electromagnetic high pressure valve, the electromagnetic high pressure valve being at least partially inserted at the end side into an opening of the common rail housing, wherein the electromagnetic high pressure valve is connected in the opening to the housing in a pressure-tight manner by means of a connection. In the inserted state of the high pressure valve in the housing, the connection comprises a first portion and at least one second portion, wherein the first portion and the at least one second portion have different mechanical and/or geometric properties.

The present invention is thus based on the idea of subdividing the connection between the housing and the electromagnetic high pressure valve into at least two differently configured portions with different properties, as a result of which, in comparison with the connections known from the prior art, a more reliable high-pressure-resistant connection is achieved.

An advantageous further development of the present invention provides that the first portion is formed in a manner that supports the sealing by the pressure applied to the end side of the high pressure valve, and that in the second portion an interference fit forms a press-fit connection between the electromagnetic high pressure valve and the housing. This preferred further development of the present invention is based on the idea of dividing the connection between the housing and the high pressure valve into at least two portions with different mechanical properties in such a way that the first area is deformed by the pressure applied in the housing and seals the connection between the high pressure valve and the housing, and in the second portion a fixed press-fit connection is formed which connects the high pressure valve to the housing. The press-fit connection is preferably dimensioned in such a way that it alone is sufficient to maintain the connection between the components under all forces that occur.

A preferred configuration of the apparatus for pressure control of the fuel feed of an internal combustion engine with a common rail injection provides that the housing is a common rail housing or a housing of a high pressure pump. In particular, it is preferred that the common rail housing has an input side that is in connection with a high pressure pump and an output side connected to at least one injector. The common rail housing or alternatively the housing of the pump is pressure-resistant for a pressure range from $1500*10^5$ PA to $3000*10^5$ Pa.

A further advantageous configuration of the present invention provides that in the first portion the rigidity of the high pressure valve is lesser than in the second portion, and that the pressure applied to the high pressure valve at the end side can elastically deform the high pressure valve in the first partial area. Due to the elastic deformation of the high pressure valve, the pressure in the housing can press the high pressure valve against the housing and achieve a high pressure tight connection.

In addition, it has proven advantageous if the housing has a higher rigidity in the opening area than the high pressure valve. Differing rigidities between the housing and the high pressure valve can be achieved by accordingly shaping the components concerned and/or by using different materials.

In addition, it has proven advantageous if a press-fit connection between the high pressure valve and the housing is formed in the first portion by an interference fit. The interference fit is preferably designed in such a way that the two parts to be connected are joinable with greater pressure and additional heating. For example, the interference fit can be formed according to the system of the hole basis system according to DIN 7154 or according to the system of the shaft basis system according to DIN 7155. The hole basis is preferably selected from a tolerance field h to z, and the shaft basis from a tolerance field H to Z. Such a fit could, for example, be H7/r7, H7/s7 or H7/u8.

Furthermore, it has proven advantageous if an interference fit is formed in the second portion and the first portion, wherein the interference fit in the second portion has a lesser interference fit than the interference fit in the first portion. Preferably, the first portion and the second portion are arranged immediately adjacent to each other.

According to a further configuration of the present invention, the connection may comprise a third portion, wherein a press-fit connection is also formed in the third portion. The press-fit connection of the third portion preferably has a lesser interference than the press-fit connection of the second portion and/or the first portion. Alternatively, a transition fit can be provided in the third portion.

According to a further advantageous configuration of the present invention, it is proposed that a consistent mating surface is formed in the opening to the housing. Typically, the opening is machined or formed into the housing as a cylindrical bore, which can preferably be reworked by a suitable manufacturing process, in particular by reaming, to provide an accurately fitting opening with a high surface quality.

Furthermore, it has proven advantageous if the high pressure valve has a valve seat body, and that the valve seat body of the high pressure valve is at least partially inserted into the opening of the housing. The valve seat body may be made of a high strength steel and has a first side and a second side, wherein the first side is the end side which is at least partially inserted into the opening of the housing. The second side may include a valve seat for a valve body or sealing ball and is disposed on the second side opposite the first side. The first side and the second side may be interconnected by an inlet channel which can be closed and opened by a cooperation of the valve body and the valve seat.

Furthermore, it has proven advantageous if the valve seat body has, at least at the end side, a circular annular cross-section, with an inner surface surrounding the inlet channel, and an outer surface. The outer surface is preferably configured to provide the interference for the press-fit connection in the second portion between the housing and the high pressure valve.

Another advantageous configuration of the present invention provides that for forming the first portion, the valve seat body comprises a cavity on an inner surface and/or an outer surface. The cavity on the inner surface and/or on the outer surface can preferably be formed as a circumferential groove and locally reduces the wall thickness of the valve seat body. The cavity can reduce the rigidity and can allow elastic deformation due to the high pressure in the inlet channel. In particular, it is preferred if the cavity is arranged on the outer surface of the valve seat body, since the outer surface is particularly easy to access for incorporation of the cavity. The valve seat body can be deformed, preferably elastically, in the area of the cavity by the pressure, wherein the adjacent areas of the outer surface of the cavity are also deformed and additionally pressed against the opening, whereby the sealing effect in the third section is considerably increased. It is, in particular, preferred if in the third section, adjacent to the cavity, the outer surface of the valve seat body has an interference which is greater than the interference of the second section.

Furthermore, it has proven advantageous if the third portion is arranged at the end side of the valve seat body, and that the second portion is arranged between the third portion and the first portion. Accordingly, the first portion, then the second portion, and finally the third portion are inserted into the opening of the housing during press-fitting. Starting from the third portion, the interference of the second portion and the third portion increases successively. The gradual or stepwise increase in the interference reduces the risk of formation of shavings when the valve seat body is pressed in, while also reducing the pressing force required. The tightness of the press-fit connection between the housing and the high pressure valve or the valve seat body can be improved by this measure.

The high pressure valve can be a pressure relief valve or a pressure control valve. It is preferred if the high pressure valve is an electromagnetic high pressure valve, in particular an electromagnetic pressure relief valve or an electromagnetic pressure control valve.

A further configuration of the present invention provides that the high pressure valve comprises a pole core having a front cavity that engages around the valve seat body. Preferably, the pole core engages around a flange of the valve seat body disposed at the second end of the valve seat body. A centering between the valve seat body and the pole core can be achieved by selecting an appropriate fit between the front cavity of the pole core and by the area of the valve body engaged by the pole core.

A particularly preferred configuration of the present invention provides that the housing at least partially engages the pole core and is fixedly connected to the pole core. The housing can have a recess that is coaxial to the opening, into which the pole core can be inserted. It is, in particular, preferred that the housing with the pole core encloses a plenum within the recess, and the pole core comprises one or more channels through which the plenum is connected to the valve seat. The housing may further include a discharge through which fuel may be discharged from the plenum and from the housing.

It has also been found to be advantageous if the housing is welded, caulked, flanged, or crimped to the pole core, wherein the housing is preferably welded to the pole core. The material bond of the welded connection enables the provision of a resilient and sealed connection between the pole core and the housing, and it is possible to dispense with conventional sealing rings made of plastics.

According to a further preferred configuration of the present invention, the housing is made of a magnetic material and an excitation coil of the high pressure valve is arranged on the housing.

Another aspect of the present invention relates to an internal combustion engine having a common rail injection as well as to a motor vehicle having such an internal combustion engine.

Figure 2:
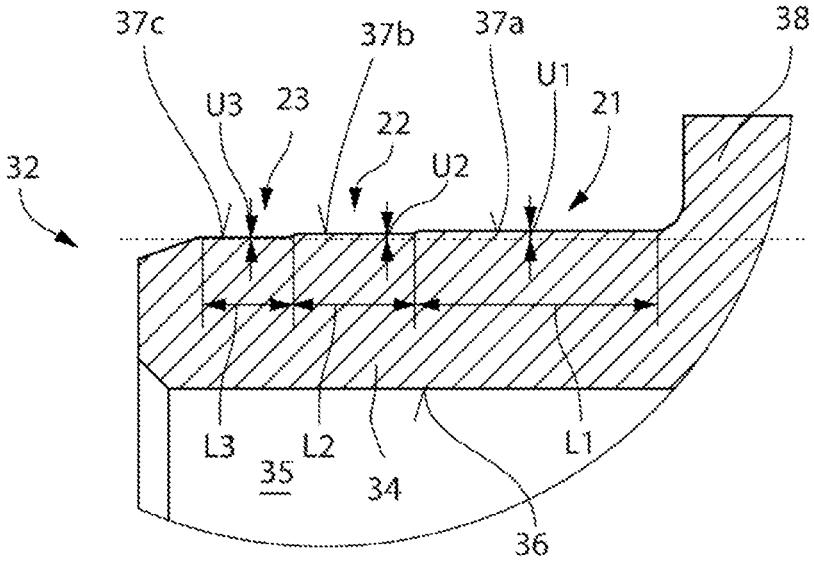
Figure 3:
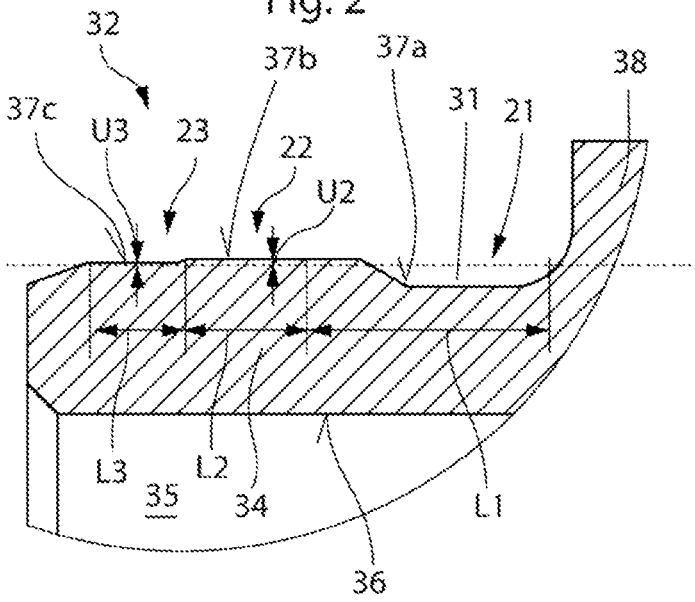
Figure 4:
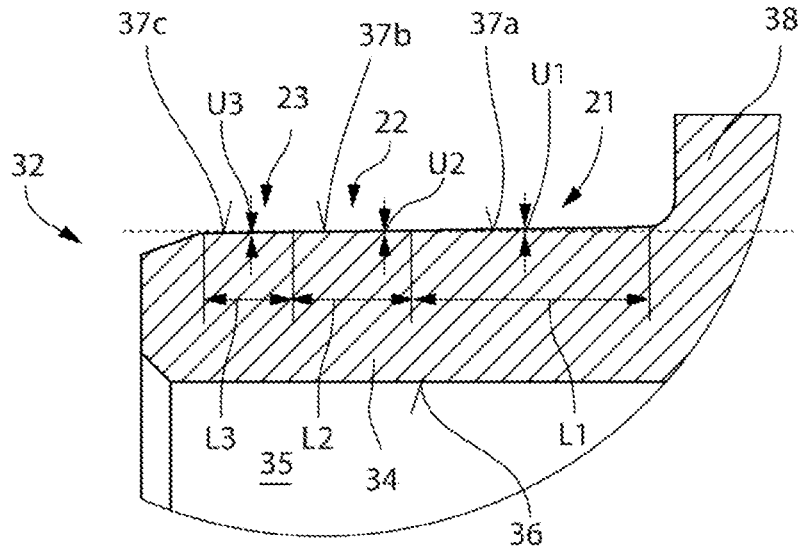
Figure 5:
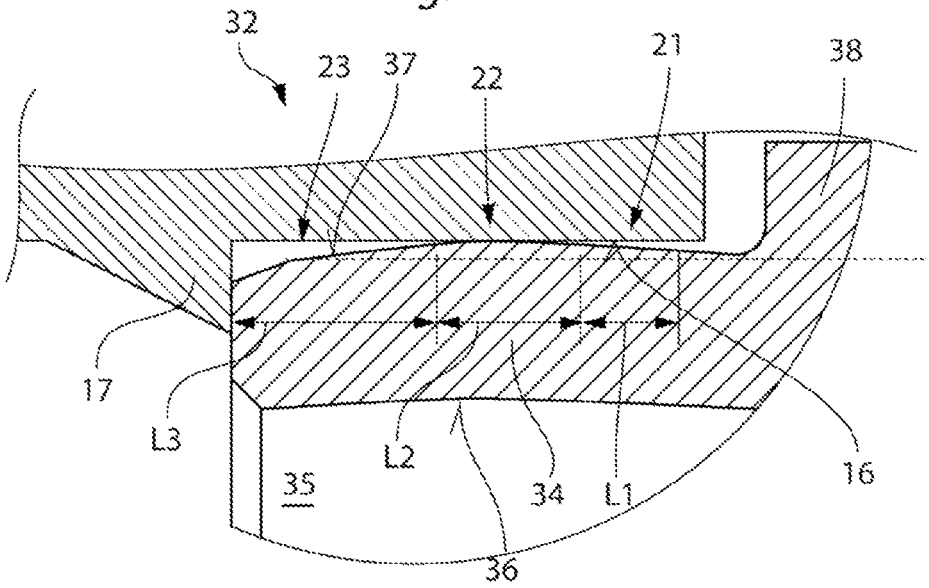

Four embodiment examples of an apparatus for pressure control in a fuel feed of an internal combustion engine having common rail injection according to the invention are described here below with reference to the accompanying drawings. Wherein:

FIG. 1 shows a cross-sectional view of an apparatus for pressure control in a fuel feed of an internal combustion engine having common rail injection with a housing and a high pressure valve inserted in an opening of the housing, FIG. 2 shows an enlarged view of a first embodiment example of the connection between the housing and the high pressure valve, FIG. 3 shows an enlarged view of a second embodiment example of the connection between the housing and the high pressure valve, FIG. 4 shows an enlarged view of a third embodiment example of the connection between the housing and the high pressure valve, and FIG. 5 shows an enlarged view of a fourth embodiment example of the connection between the housing and the high pressure valve.

In the following, identical or functionally identical components are identified with the same reference signs. For the sake of clarity, not all identical or functionally identical parts are given a reference number in the individual figures. It is already noted at this point that the features of the embodiment examples described below can be combined with each other.

FIG. 1 shows a section of a common rail system of an internal combustion engine of a motor vehicle with a common rail injection. The system typically consists of a tank (not shown) for the fuel, from which fuel is supplied to a pump device (not shown) via a suitable line passing through a fuel filter (not shown). On the output side, the pump device is in connection with an input side of a generally tubular common rail housing 10. This common rail housing is, in turn, connected on the output side via suitable (not shown) feed lines and (not shown) openings to one or more (not shown) injectors
which are configured to inject the fuel into a cylinder (not shown).

The pumping device can impinge the fuel in the common rail housing 10 with a pressure of up to $3000*10^5$ Pa, i.e. 3000 bar, wherein the housing 10 comprises an opening 15 into which a high pressure valve 30, preferably an electromagnetic high pressure valve 30, can be inserted. The electromagnetic high pressure valve 30 can open at a predefined overpressure, whereby excess fuel can be returned from the common rail housing 10 to the tank via an outlet 19 and lines (not shown).

As can further be seen from FIG. 1, the high pressure valve 30 is inserted into the opening 15, which high pressure valve is arranged in a pressure-tight manner in the opening 15 by means of a connection 20. The high pressure valve 30 is preferably, and as shown, an electromagnetic high pressure valve 30 or an electromagnetic pressure control or pressure relief valve.

The electromagnetic high pressure valve 30 is arranged along a longitudinal axis X and comprises a valve seat body 32, pole core 40, an electromagnetic excitation system 50, an armature 42, a tappet 45 coupled to the armature 42 with a sealing ball 46 and a pot-shaped housing part 48.

The electromagnetic excitation system 50 comprises a coil 52 wound on a coil body 51, which coil is connectable to a power supply device via a plug connector 55.

The pole core 40 has a first end area, a second end area, and a through opening 41 that is coaxial to the longitudinal axis X, through which through opening the tappet 45 projects movably. The first end area faces the opening 15 of the common rail housing 10 and has a cylindrical front cavity 44 which is open to the free end of the pole core 40 and is arranged coaxially to the longitudinal axis X. The pole core 40 moreover has a plurality of channels 43 in the first end area which connect the through opening 41 to an outer circumferential surface of the pole core 40 and arranged radially with respect to the longitudinal axis X.

The valve seat body 32 is a rotationally symmetrical component, preferably made of a high-strength steel, having a first side and a second side, wherein a circumferential flange 38 may be arranged on the second side of the valve seat body 32. Furthermore, the valve seat body 32 has an inlet channel 35 which, starting from the first side of the valve seat body 32, connects the first side to the second side and, on the second side, opens into a preferably conical valve seat 33 which can be closed or released by the sealing ball 46.

A hollow shaft section 34 of the valve seat body 32 with an inner surface 36 and an outer surface 37 protrudes from the flange 38 in the direction of the first side, wherein the inner surface 36 surrounds the inlet channel 35. Correspondingly, the valve seat body 32 is annular in cross-section. The flange 38 at the second end of the valve seat body 32 is inserted into the cylindrical cavity 44 in the first end area of the pole core 40, and the pole core 40 almost completely surrounds the flange 38 of the valve seat body 32.

In the second end area, the pole core 40 is connected to the pot-shaped housing part 48 by means of a short circuit ring 47 and the pot-shaped housing part 48 is arranged around the armature 42 in such a way that the armature 42 together with the tappet 45 and the sealing ball 46 can undertake an adjustment movement along the longitudinal axis X. The short circuit ring 47 and the pot-shaped housing part 48 tightly seal the side of the pole core 40 facing away from the valve seat body 32.

The electromagnetic excitation system 50 is arranged on the pole core 40, the short circuit ring 47 and the pot-shaped housing part 48, whereby when the coil 52 is energized, the armature 42 is supplied together with the tappet 45 and the sealing ball 46, and the sealing ball 46 is pressed into the valve seat 33 of the valve seat body 32 and closes it. In the de-energized state of the coil 52, the electromagnetic high pressure valve 30 is open and fuel can flow out of the common rail housing 10.

In the opening 15 of the common rail housing 10, the electromagnetic high pressure valve 30 is connected to the common rail housing 10 by a connection 20 in the form of a non-detachable and pressure-tight press-fit connection.

During assembly of the high pressure valve 30, or alternatively of the preferred electromagnetic high pressure valve 30, the electromagnetic high pressure valve 30 is initially connected to the common rail housing 10 in the opening 15 by means of a connection 20 in the form of a non-detachable and pressure-tight press-fit connection in the opening 15. The pole core 40 is furthermore inserted into a recess, which is preferably arranged coaxially to the opening 15, up to a stop formed by a circumferential flange in the common rail housing 10 and enclosed by the same in areas.

The pole core 40 encloses a plenum in the recess with the common rail housing 10, wherein the plenum is connected to the inlet channel 35 by means of channels 43 through the pole core 40 and via the valve seat 33. The common rail housing 10 may include an outlet through which fuel discharged from the common rail housing 10 may be returned from the plenum to the tank (not shown).

In the embodiment example of FIG. 1, the pole core 40 is preferably connected to the common rail housing 10 by means of a circumferential welded connection, wherein a sealing ring 60 may be provided in a circumferential groove of the pole core 40 to ensure a seal between the pole core 40 and the common rail housing 10. However, the welded connection also allows the sealing ring 60 to be dispensed with, making the apparatus 1 suitable for use with synthetic fuels that are not compatible with conventional sealing rings.

Alternatively, the common rail housing 10 may project in a tubular shape beyond the pole core 40, wherein the electromagnetic excitation system 50 is arranged on the outer periphery of the common rail housing 10. The common rail housing 10 is part of the magnetic circuit of the electromagnetic high pressure valve 30 and, for this purpose, must, at least in this area, be made of a magnetic material. Such an arrangement enables a particularly small and compact design of the present apparatus 1 for pressure control in a fuel feed to an internal combustion engine with a common rail injection.

The pressure-tight connection 20 is realized between the outer surface 37 of the hollow shaft section of the valve seat body 32 and the opening 15 by a press-fit connection, wherein the connection 20 can be subdivided into at least two, preferably three portions 21, 22 and 23.

In the illustrated embodiment examples according to FIGS. 1-3, the opening 15 of the common rail housing 10 is a cylinder bore with a uniform mating surface, for example, with an H7 hole basis according to DIN 7154, where, in the meantime, the outer surface 37 used for forming the portions 21, 22, 23 has different geometric and/or mechanical properties, which are explained below with reference to FIG. 2 and FIG. 3.

The detailed view of the valve seat body 32 according to FIG. 2 shows that the outer surface 37 of the hollow shaft section 34 has three portions 21, 22, 23. The three portions 21, 22, 23 divide the hollow shaft section 34 into three step-shaped outer surfaces 37*a*, 37*b*, 37*c*, which can be connected by conical transitions.

The outer surface 37*a* forms the first portion 21 and is disposed adjacent the flange 38 on the hollow shaft section 34 at the second end of the valve seat body 32. The outer surface 37*c* forms the third portion 23 and is disposed adjacent the first end of the valve seat body 32. The outer surface 37*b* is disposed between the outer surface 37*a* and 37*c* and forms the second portion 22.

The portions 21, 22, 23 have different mechanical and/or geometric properties. The outer surface 37*c* in the third portion 23 is configured to form an interference fit with the opening 15 with an interference or clearance U1. The outer surface 37*b* in the second portion 22 is configured to form an interference fit with the opening 15 with an interference U2, wherein the interference U2>U1. The outer surface 37*a* in the first portion 21 is configured to form an interference fit with the opening 15 with an interference U3.

The first portion 21 or alternatively the outer surface 37*a* has a length L1 parallel to the longitudinal axis X, the second portion 22 or alternatively the outer surface 37 *b* has a length L2, and the third portion 23 or alternatively the outer surface 37 *c* has a length L3, wherein, for example, the following can apply to the lengths: L1>L2>L3. It is, in particular, preferred if the length L1>1.5*L3, preferably L1>2.5*L3.

The outer surface 37 and/or the inner surface 36 may have a chamfer at the first end, wherein the chamfer on the outside may have a chamfer angle of about 30° and the chamfer on the inner surface 36 may have a chamfer angle of about 45°.

To connect the electromagnetic high pressure valve 30 to the common rail housing 10, the valve seat body 32 is pressed into the opening 15 of the common rail housing along the longitudinal axis X, wherein the different interferences U1, U2, U3 prevent shavings from forming when the valve seat body 32 is pressed in, which could impair the tightness of the connection 20. In the first portion 21, the connection between the valve seat body 32 and the common rail housing 10 is made by means of an interference fit with a large interference U1. In the second portion, the connection between the valve seat body 32 is also an interference fit, however due to the smaller interference U2, this connection 20 is not completely pressure-tight, but rather leads to a strong drop in pressure. In the first portion, a connection between the valve seat body 32 and the common rail housing 10 can be made by a transition fit or an interference fit with a small interference U3.

The outer surface 37 according to the second embodiment example shown in FIG. 3 differs from the embodiment example shown in FIG. 2 in the configuration of the first portion 21.

The first portion 21 is configured in a manner that supports the sealing by the pressure applied to the end side of the electromagnetic high pressure valve 30. For this purpose, the first portion 21 has a cavity 31 on the outer surface 37*a*, which can be formed as a circumferential groove. The cavity 31 reduces a wall thickness of the hollow shaft section 34 in such a way that a fuel pressure applied at the end side in the inlet channel 35 can elastically deform the hollow shaft section 34 in the area of the cavity 31, whereby the area adjacent to the cavity 31 of the first portion 21 is pressed against the opening 15 of the common rail housing 10 in a manner that supports the sealing by pressure.

Alternatively, or in addition, the cavity 31 may also be arranged on the inner surface 36 of the hollow shaft section 34, wherein the cavity 31 on the inner surface 36 of the hollow shaft section is more complex to manufacture.

According to FIG. 4, the outer surface 37 may not be formed by step-shaped portions 21, 22, 23, but rather from at least one cone surface 37*d*. Together with the opening 15 of the housing 10, the cone shell surface 37*d* may equally form a transition or clearance fit in the third portion 23, a mild interference fit in the second portion 22, and an interference fit in the first portion 21.

The transition fit is preferably arranged on the free first side of the valve seat body 32 or alternatively on the hollow shaft section 34 and provides centering when inserted or pressed into the opening 15. A preferably continuous increase of the interference causes, on the one hand, a reduction in pressure in the axial gap between the high pressure valve 30 and the housing 10 and results in a pressure-tight connection 20 being formed between the first side and the second side by an interference fit.

In addition, a further portion can be provided with a cylindrical circumferential surface and/or a cavity 31 on the inner surface 36 and/or the outer surface 37*d*.

According to the fourth embodiment example shown in FIG. 5, the at least two portions 21, 22, 23 are formed by deformation in the inserted state. The outer surface 37 of the valve seat body 32 or alternatively of the hollow shaft section 34 can be a cylindrical circumferential surface before insertion into the opening 15, which is matched to the opening 15 as a clearance or the transition fit. Accordingly, the hollow shaft section 34 can be smoothly inserted in the axial direction into the opening 15 along the longitudinal axis X.

A stop 17 is provided in the opening 15, which projects radially inwards into the housing 10 in a flange shape. The mating surface 16 in the opening 15 closes off next to the stop 17, and the stop 17 can specify the position of the valve seat body 32 in the opening 15 in the longitudinal axis X.

To form the pressure-tight connection 20, the valve seat body 32 or the high pressure valve 30 is pressed into the end of the opening 15 against the stop 17 until a deformation is formed. The hollow shaft section 34 is deflected radially—preferably elastically—by the pressing force and pressed against the opening 15, whereby in this portion 22 the pressure-tight connection 20 is formed as a press-fit connection. The axial pre-tensioning of the hollow shaft section 34 in the opening 15 against the stop 17 should then be maintained. For this purpose, the pole core—as shown in FIG. 1—can be connected to the housing 10 by applying an axial force in such a way that the valve seat body 32 is held compressed in the longitudinal axis X and the pressure-tight connection 20 is permanently formed by a deflection.

The radial deflection or alternatively deformation of the hollow shaft section 34 can be facilitated by a cavity 31 on the inner surface 36 and/or outer surface 37. As previously explained, the cavity 31 can also locally reduce the rigidity of the hollow shaft section 34, which is why a pressure-assisted additional sealing effect can be exhibited.

In addition, the housing 10 and the high pressure valve 30 or alternatively its valve seat body 32, and more specifically its hollow shaft section 34, can have different rigidities, wherein the rigidity of the housing 10 is preferably greater than the rigidity of the high pressure valve 30 or alternatively its valve seat body 32. As soon as an overpressure occurs in the housing 10, the high pressure valve 30 expands to a greater extent than the housing 10, which is why the connection 20 arranged in the axial gap is kept pressure-tight with pressure assistance.

REFERENCE LIST

1 Apparatus
10 Housing
15 Opening
16 Mating surface
17 Stop
19 Outlet
20 Connection
21 First portion
22 Second portion
23 Third portion
30 High pressure valve
31 Cavity
32 Valve seat body
33 Valve seat
34 Hollow shaft section
35 Inlet channel
36 Inner surface
37 Outer surface
38 Flange
40 Pole core
41 Through opening
42 Armature
43 Channel
44 Cavity
45 Tappet
46 Sealing ball
47 Short circuit ring
48 Housing part
50 Excitation system
51 Coil body
52 Coil
55 Plug connector
60 Sealing ring
X Longitudinal axis

The invention claimed is:

1. An apparatus (1) for pressure control in a fuel feed of an internal combustion engine having common rail injection, comprising:

a housing (10) with an opening (15); and a high pressure valve (30), wherein a uniform mating surface (16) is provided in the opening (15) on the housing (10), wherein the high pressure valve (30) is at least partially inserted on an end side into the opening (15) of the housing (10), wherein, in the inserted state, the high pressure valve (30) in the opening (15) is connected by a connection (20) in a pressure-tight manner to the housing (10) and the connection (20) comprises a first portion (21), a second portion (22), and a third portion (23), wherein the first portion (21) the second portion (22) and the third portion (23) divide a hollow shaft section (34) into three step-shaped outer surfaces (37*a*, 37*b*, 37*c*) having different mechanical and/or geometrical properties, and wherein the third portion (23) forms a press-fit connection having a smaller interference than an interference of the first portion (21) and/or an interference of the second portion (22).

2. The apparatus (1) according to claim 1, wherein the first portion (21) is formed in a manner that supports the sealing by a pressure applied to the end side of the high pressure valve (30), and that in the second portion (22) an interference fit forms a press-fit connection.

3. The apparatus (1) according to claim 1, wherein the housing (10) is a housing (10) of a high pressure pump or is a common rail housing (10), and the common rail housing (10) is in connection on an inlet side to a high pressure pump and on an output side to at least one injector.

4. The apparatus (1) according to claim 1, wherein a rigidity of the high pressure valve (30) in the first portion (21) is lesser than in the second portion (22), and the pressure applied at the end side can elastically deform the high pressure valve (30) in the first portion (21).

5. The apparatus (1) according to claim 1, wherein a rigidity of the high pressure valve (30) is lesser than a rigidity of the housing (10) in an area of the opening (15).

6. The apparatus (1) according to claim 1, wherein a press-fit connection between the high pressure valve (30) and the housing (10) is formed in the first portion (21) by an interference fit.

7. The apparatus (1) according to claim 1, wherein an interference fit is formed in the second portion (22), which has a smaller interference than the interference in the first portion (21), and a press-fit connection is formed between the high pressure valve (30) and the housing (10).

8. The apparatus (1) according to claim 1, wherein the high pressure valve (30) has a valve seat body (32), and the valve seat body (32) of the high pressure valve (30) is at least partially inserted into the opening (15) of the housing (10).

9. The apparatus (1) according to claim 8, wherein the valve seat body (32) has a circular annular cross-section at an end side with an inner surface (36) surrounding an inlet channel (35) and the outer surfaces (37*a*, 37*b*, 37*c*), and wherein the outer surface (37*b*) is provided with an interference to form the second portion (22).

10. The apparatus (1) according to claim 8, wherein the valve seat body (32) has a circumferential cavity (31) on an inner surface (36) and/or on the outer surface (37*a*) for forming the first portion (21).

11. The apparatus (1) according to claim 8, wherein the third portion (23) is arranged at an end side of the valve seat body (32) and the second portion (22) is arranged between the third portion (23) and the first portion (21).

12. The apparatus (1) according to claim 1, wherein the high pressure valve (30) is a pressure control valve or a regulating valve.

13. The apparatus (1) according to claim 1, wherein the high pressure valve (30) has a pole core (40) with a front cavity (44) which cavity engages the valve seat body (32).

14. The apparatus (1) according to claim 13, wherein the housing (10) at least partially surrounds the pole core (40) and is fixedly connected to the pole core (40).

15. The apparatus (1) according to claim 13, wherein the housing (10) is welded, caulked, flanged or crimped to the pole core (40).

16. The apparatus (1) according to claim 1, wherein the housing (10) is made of a magnetic material and an excitation system (50) of the high pressure valve (30) is arranged on the common rail housing (10).

17. An internal combustion engine with a common rail injection, comprising at least one apparatus (1) according to claim 1.

18. The apparatus (1) according to claim 12, wherein the pressure control valve comprises an electromagnetic pressure control valve.

* * * * *